US005233897A

United States Patent [19]

Wick

[11] Patent Number: 5,233,897

[45] Date of Patent: Aug. 10, 1993

[54] ORGAN REED PIPE SHALLOT

[75] Inventor: Scott M. Wick, Highland, Ill.

[73] Assignee: Wicks Organ Company, Highland, Ill.

[21] Appl. No.: 664,829

[22] Filed: Mar. 5, 1991

[51] Int. Cl.[5] ..... G10B 3/08; G10F 1/12

[52] U.S. Cl. ..... 84/350; 84/83; 84/91

[58] Field of Search ..... 84/83, 84–91, 84/402, 408, 410, 380 C, 350, 351, 360, 361, 362

[56] References Cited

U.S. PATENT DOCUMENTS 539,595 5/1895 Schwertner ..... 84/350
1,594,477 8/1926 Smith ..... 84/83
2,970,507 11/1958 Bolton ..... 84/350
4,023,455 5/1977 Peterson .
4,079,653 3/1978 Finch .

*Primary Examiner*—Michael L. Gellner
*Assistant Examiner*—Cassandra C. Spyrou
*Attorney, Agent, or Firm*—Rogers, Howell & Haferkamp

[57] ABSTRACT

An organ reed pipe shallot is constructed from solid metal bar stock cut to a predetermined axial length and having a tapered internal bore formed axially through the center of the bar stock. A side of the bar stock is planed and a slot is cut in the plane that extends through to the internal bore. An end plate is secured over one end of the bar stock adjacent the slot and covering the internal bore opening at that end of the bar stock.

6 Claims, 1 Drawing Sheet

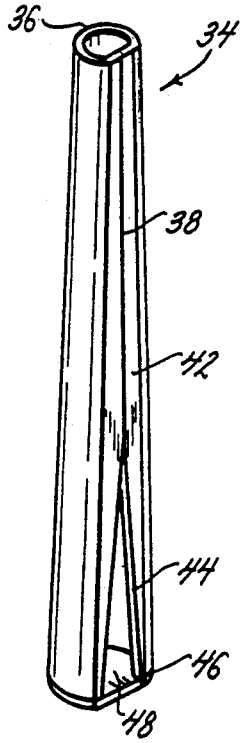
FIG. 2.
(PRIOR ART)
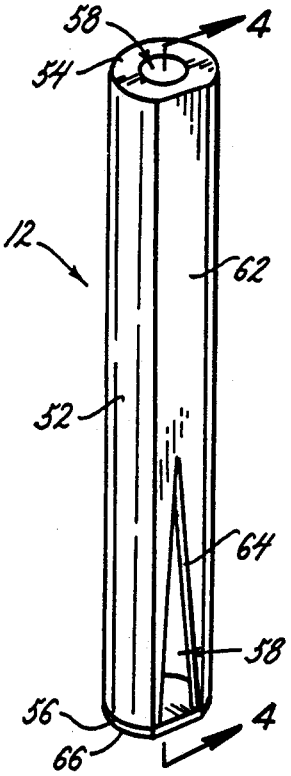
FIG. 3.
FIG. 1.
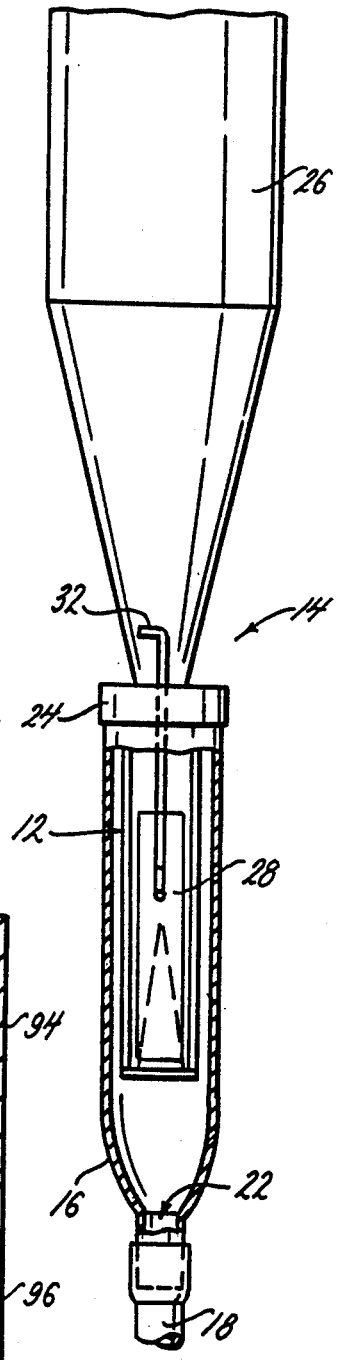
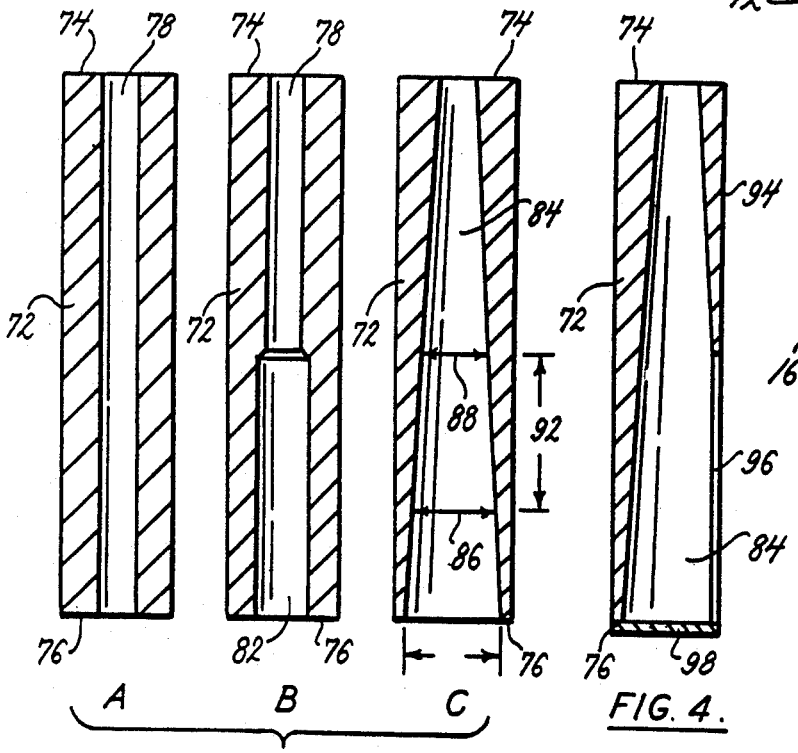
FIG. 6.
FIG. 4.
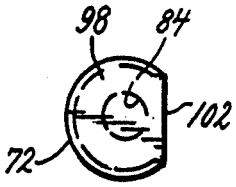
FIG. 5.

ORGAN REED PIPE SHALLOT

BACKGROUND OF THE INVENTION (1) Field of the Invention

The present invention relates to an organ reed pipe shallot and its method of construction. In particular, the present invention relates to an organ reed pipe shallot that is constructed from a solid piece of metal bar stock. The shallot is generally constructed by cutting the bar stock to a predetermined length, boring a tapered bore through the center of the cut bar stock, and then planing a side of the bar stock and cutting a slot through the planed side.

(2) Description of the Related Art

Prior art organ reed pipe shallots are generally formed by cutting a flat sheet of metal in a trapezoidal configuration. The cut sheet of metal is then formed on a mandrel into a general cone shape. In forming the sheet on the mandrel, opposite side edges of the trapezoidal sheet are wrapped around the mandrel and meet each other along a seam. The seam extends axially along one side of the shallot formed from the sheet. The side of the shallot with the seam is then flattened, and a slot is cut through the flattened side adjacent the base or widest end of the shallot. A bottom plate is secured over the bore opening at the base of the shallot. The bottom plate and the side edges of the sheet along the seam are secured by soldering or other equivalent means.

The prior art method of constructing shallots has been found to be disadvantaged in that it is a very exacting and time consuming procedure. The prior art method requires considerable time and effort in cutting the properly dimensioned trapezoidal sheet, and in forming the shallot so that the side edges of the trapezoidal sheet meet each other at all points along the seam formed in the shallot. Constructing shallots according to the prior art method requires several different metal working procedures, each of which provide ample opportunity for errors to be made in the shallots construction. The number of construction steps involved and the occasional errors that occur in performing these construction steps contribute significantly to the overall cost of producing each shallot.

SUMMARY OF THE INVENTION

The organ reed pipe shallot of the present invention overcomes disadvantages associated with prior art shallots and their method of construction by providing a shallot having a more simplified method of construction than that of the prior art. The shallot of the present invention is also constructed according to a method that requires less time and produces a shallot having a more solid construction than that of the prior art.

The shallot of the present invention is constructed from solid metal bar stock. The shallot is formed from a cylindrical bar cut from the bar stock, the bar having a predetermined axial length between its opposite first and second ends. A tapered internal bore is formed axially through the center of the bar, and the exterior of the bar is planed axially along one side. A slot is cut into the planed side of the bar through to the internal bore. The slot is cut at the end of the bar adjacent the largest end of the tapered internal bore. An end plate is secured covering over the bar end adjacent the slot.

Constructing the shallot of the invention in this manner provides a shallot of solid metal having more mass and a more solid construction than prior art shallots. Its method of construction is more simplified than that of prior art shallots and is less time consuming than that of prior art shallots.

BRIEF DESCRIPTION OF THE DRAWING FIGURES

Further objects and features of the present invention are revealed in the following detailed description of the preferred embodiment of the invention and in the drawing figures wherein:

FIG. 1 is an elevation view partially in section of the shallot of the invention assembled in an organ reed pipe;

FIG. 2 is a perspective view of a prior art shallot;

FIG. 3 is a perspective view of the shallot of the present invention;

FIG. 4 is a side elevation view in section of the shallot of the present invention taken along the line 4—4 of FIG. 3;

FIG. 5 is a plan view of the bottom of the shallot of the present invention; and, FIGS. 6A–6C are side elevation views in section depicting the method of constructing the shallot of the present invention.

DETAILED DESCRIPTION OF THE PREFERRED EMBODIMENT

A schematic representation of the operative environment of the shallot 12 of the present invention is shown in FIG. 1 of the drawing figures. FIG. 1 shows the general structure of a reed pipe 14 of an organ. The reed pipe includes a boot 16 that communicates with an air supply 18 of the organ (not shown) through a foot hole 22. A block 24 is provided at the top of the boot, and a resonator body 26 extends upward from the block. The shallot 12 of the invention is mounted in an underside of the block 24 and extends downward into the interior of the boot 16. A reed 28 is mounted on one side of the shallot 12 and a tuning wire 32 extends through the block 24 and into the interior of the boot 16 where it engages against the reed 28.

The reed pipe structure shown in FIG. 1 is intended to be illustrative of the operative environment of the invention and is not intended to be limiting. The shallot 12 of the present invention may be employed in organ reed pipes having structures different from that shown in FIG. 1.

The shallot 12 of the present invention affords several advantages over prior art shallots. A shallot of the type known in the prior art is shown in FIG. 2. Prior art shallots 34 of this type are generally formed by cutting a flat sheet 36 of metal in a trapezoidal configuration, and then forming the sheet on a mandrel (not shown) into a three-dimensional cone shape. In forming the sheet into the cone shape of the shallot 34, opposite side edges of the trapezoidal sheet 36 are brought together and meet along a seam 38 along one side of the shallot. The side 42 of the cone over which the seam 38 extends is then flattened, and a slot 44 having a triangular or similar shape is cut into the flattened side 42. The slot is cut adjacent the base 46 of the shallot cone. A bottom plate 48 is then secured over the opening at the base 46 of the shallot. The bottom plate 48 and the edge of the sheet at the base 46 of the shallot, and the opposite side edges of the metal sheet secured at the seam 38, are soldered together or are secured together in some other equivalent manner.

The number of steps required in constructing the prior art shallot 34 shown in FIG. 2 contribute significantly to the overall time and cost of producing the shallot. The construction steps are also very exacting and require considerable effort in cutting the metal sheet to the proper shape, and in forming the sheet so that the side edges meet each other at all points along the seam. The prior art construction methods provide ample opportunity for errors which also increase the production costs per shallot.

The shallot of the present invention overcomes these disadvantages of prior art shallots by providing a shallot of solid construction that is constructed according to a method that requires fewer steps and presents fewer opportunities for error than methods employed in constructing prior art shallots.

The shallot 12 of the present invention is shown in FIG. 3. The shallot has the general configuration of a cylindrical bar 52 with opposite first and second ends 54, 56. The axial length of the bar 52 between its first and second ends is predetermined and is based on the desired sound to be produced by the shallot when employed in the reed pipe of FIG. 1 or a similar reed pipe.

A tapered, internal bore 58 extends axially through the center of the shallot between its first and second ends 54, 56. The internal bore 58 has its largest internal diameter at the second end 56 of the shallot, and tapers down to its smallest internal diameter at the first end 54 of the shallot.

A plane 62 is formed over one exterior side of the shallot 12 and a slot 64 is cut in the plane 62. The slot 64 is cut adjacent the shallot second end 56. The slot is cut from the plane 62 through to the internal bore 58 of the shallot. Although the slot shown has a triangular configuration, the slot may be cut to different shapes depending on the desired sound to be produced by the shallot.

An end plate 66 is secured to the second end 56 of the shallot. The plate covers over the opening of the internal bore 58 at the shallot second end. The plate is secured to the shallot end by soldering or by other equivalent means.

The series of sequential steps involved in producing the shallot of the invention according to the method of the invention are shown in FIG. 6. In describing the method of the invention, different reference numerals are given to the component parts of the shallot in FIGS. 4, 5 and 6 than were used to describe the shallot of the invention shown in FIGS. 1 and 3.

In constructing the shallot of the invention, a solid cylindrical piece of metal bar stock 72 having a predetermined circumference is first cut to a predetermined axial length between its opposite first and second ends 74, 76. The circumference of the shallot and the predetermined axial length are determined based on size constraints of the reed pipe with which the shallot will be used and the desired sound to be produced by the reed pipe.

After cutting the bar stock to the desired length, the next step in producing the shallot of the present invention involves determining the dimensions of the tapered internal bore of the shallot. These dimensions are again determined based on the desired sound to be produced by the shallot. With the dimensions of the internal tapered bore determined, a first conduit 78 is drilled through the center of the bar stock 72 between the first and second ends 74, 76. The diameter of the first conduit 78 is consistent throughout the interior of the bar stock and is preferably slightly smaller than the smallest diameter of the tapered internal bore determined to be formed in the bar stock.

Next, a second conduit 82 is drilled through the center of the bar stock from the second end 76 to about the midpoint of its axial length. Preferably, the internal diameter of the second conduit 82 is slightly smaller than the diameter of the internal tapered bore determined for the shallot at the axial midpoint of the bar stock 72.

Next, the desired taper to the internal bore is formed by reaming out the first and second conduits 78, 82 formed through the interior of the bar stock 72. The reamed internal bore 84 is tapered so that the internal diameter of the bore tapers along the axial length of the bore. For example, although FIG. 6C is not drawn to scale, the tapered internal bore 84 of the shallot 72 shown in FIG. 6C will have an inner diameter at a first cross section 86 that is larger than the inner diameter of the bore at a second cross section 88 that is spaced an axial distance 92 down the bore from the first cross section.

With the tapered bore 84 reamed through the center of the bar stock 72, a plane 94 is next milled in the bar stock exterior surface. The plane 94 is provided for mounting a reed to the shallot and extends the entire axial length of the shallot.

Next, a slot 96 is cut in the plane 94 through to the internal bore 84. The slot 96 in the embodiment of the invention shown in the drawing figures has a triangular configuration with the base of the triangle being adjacent the second end 76 of the shallot. The triangular configuration of the slot 96 is only illustrative. The slot may be cut in other configurations depending on the type of sound desired to be produced by the shallot.

An end plate 98 is next secured to the second end 76 of the bar stock 72. The end plate 98 covers over the opening of the internal bore 84 at the second end 76 of the bar stock, and is secured to the second end of the bar stock by soldering or any other equivalent means. As is best seen in FIG. 5, the end plate 98 is substantially circular and has the same circumference as the external circumference of the bar stock. However, the plate is flattened on one side 102 so that it fits flush with the plane 94 formed in the one side of the bar stock 72 when secured to the second end 76 of the bar stock. Securing the plate 98 to the second end 76 of the bar stock completes the construction of the shallot of the invention.

Although the preferred method of constructing the shallot of the invention has been described above with reference to FIGS. 4, 5 and 6, it should be understood that variations may be made to the above described method without departing from the intended scope of the invention defined in the claims.

While the shallot of the present invention has been described by reference to a specific embodiment, it should be understood that modifications and variations of the invention may be constructed without departing from the scope of the invention defined in the following claims.

What is claimed is:

1. A shallot for use in a reed pipe of an organ, the shallot comprising:

a longitudinal bar having a predetermined length and a bore extending therethrough, the bore having a centerline defining a center axis of the bar;

the bar having a first end surface oriented at generally a right angle to the center axis of the bar, and the bar having a second end surface spaced for the first end surface;

the bore being tapered and having a first radius in a plane co-planar with the first end surface of the bar and a second radius in a plane co-planar with the second end surface of the bar, the first radius being greater than the second radius; and the bar having at least one generally planar exterior surface extending generally parallel to and at a spaced distance from the center axis of the bar, the spaced distance being greater than the second radius of the bore and the spaced distance being less than the first radius of the bore, whereby a tapered slot is formed in the planar exterior surface of the bar adjacent the first end surface and spaced from the second end surface.

2. The shallot of claim 1 wherein the bar is solid metal.

3. The shallot of claim 1 wherein the bar has a cylindrical exterior surface with the planar exterior surface formed thereon.

4. The shallot of claim 3 wherein the bar has a consistent circumference between the first and second end surfaces.

5. The shallot of claim 4 wherein the slot has a triangular configuration.

6. The shallot of claim 5 wherein the second end surface is oriented at generally a right angle to the center axis of the bore.

* * * * *